US012146223B2

(12) United States Patent
Zhang et al.

(10) Patent No.: US 12,146,223 B2
(45) Date of Patent: Nov. 19, 2024

(54) NiCrBSi—$ZrB_2$ METAL CERAMIC POWDER, COMPOSITE COATING FOR HIGH TEMPERATURE PROTECTION, AND PREPARATION METHOD THEREFOR

(71) Applicant: ANHUI UNIVERSITY OF TECHNOLOGY, Maanshan (CN)

(72) Inventors: Shihong Zhang, Maanshan (CN); Xia Liu, Maanshan (CN); Kai Hu, Maanshan (CN); Zhaolu Xue, Maanshan (CN); Yang Yang, Maanshan (CN); Kang Yang, Maanshan (CN)

(73) Assignee: ANHUI UNIVERSITY OF TECHNOLOGY, Maanshan (CN)

( * ) Notice: Subject to any disclaimer, the term of this patent is extended or adjusted under 35 U.S.C. 154(b) by 65 days.

(21) Appl. No.: 18/161,816

(22) Filed: Jan. 30, 2023

(65) Prior Publication Data

US 2023/0193445 A1 Jun. 22, 2023

Related U.S. Application Data

(63) Continuation of application No. PCT/CN2022/072124, filed on Jan. 14, 2022.

(30) Foreign Application Priority Data

Jan. 18, 2021 (CN) ..... 202110062825.6

(51) Int. Cl.
*C23C 4/073* (2016.01)
*B22F 1/065* (2022.01)
(Continued)

(52) U.S. Cl.
CPC ..... *C23C 4/073* (2016.01); *B22F 1/065* (2022.01); *B22F 1/103* (2022.01); *B22F 3/1007* (2013.01);
(Continued)

(58) Field of Classification Search
CPC ..... C23C 4/073; C23C 4/129; B22F 1/103; B22F 1/065; B22F 3/1007; B22F 9/04; B22F 9/082; C22C 32/0073
See application file for complete search history.

(56) References Cited

U.S. PATENT DOCUMENTS 6,254,938 B1 7/2001 Pranevicius et al.
6,780,474 B2 8/2004 Smith et al.
9,816,169 B2 1/2017 Xie

FOREIGN PATENT DOCUMENTS

CN 1886535 * 12/2006
CN 1886535 A 12/2006
(Continued)

OTHER PUBLICATIONS

Chun Guo et al., Tribology Transactions, Effect of ZrB2 on the Microstructure and Wear Resistance of Ni-Based Composite Coating Produced on Pure Ti by Laser Cladding, Nov. 24, 2010, pp. 80-86, Taylor & Francis, England.

*Primary Examiner* — Nathan T Leong
(74) *Attorney, Agent, or Firm* — True Shepherd LLC; Andrew C. Cheng

(57) ABSTRACT

The metal ceramic powder with a particle size of 15-45 μm and suitable for thermal spraying is prepared through a combination of mechanical ball milling, spray granulation, and vacuum sintering. The metal ceramic powder is sprayed on a surface of a steel substrate adopting the high velocity oxygen fuel (HVOF) technology with oxygen-propane as fuel and taking oxygen as a combustion improver, propane as fuel, nitrogen as powder feeding carrier gas, and air as a cooling medium to prepare and form the NiCrBSi—$ZrB_2$ composite coating. The present disclosure solves the problem that $ZrB_2$ ceramic is difficult to compact during sintering and improves powder bonding strength and fluidity. The preparation method is simple, has advantages of high coat-
(Continued)

ing deposition efficiency and convenient equipment operation, and is cost-effective. The preparation method can improve thermal corrosion resistance and high-temperature wear resistance of a surface of boiler, and prolonging lifetime of the boiler.

5 Claims, 7 Drawing Sheets

(51) Int. Cl.

| | |
|---|---|
| ***B22F 1/103*** | (2022.01) |
| ***B22F 3/10*** | (2006.01) |
| ***B22F 9/04*** | (2006.01) |
| ***B22F 9/08*** | (2006.01) |
| ***C22C 32/00*** | (2006.01) |
| ***C23C 4/129*** | (2016.01) |

(52) U.S. Cl.
CPC ..... *B22F 9/04* (2013.01); *B22F 9/082* (2013.01); *C22C 32/0073* (2013.01); *C23C 4/129* (2016.01); *B22F 2009/043* (2013.01); *B22F 2201/20* (2013.01); *B22F 2202/01* (2013.01); *B22F 2304/10* (2013.01); *B22F 2998/10* (2013.01); *B22F 2999/00* (2013.01)

(56) References Cited

FOREIGN PATENT DOCUMENTS

| | | | | |
|---|---|---|---|---|
| CN | 101884892 | A | | 11/2010 |
| CN | 107914005 | | * | 4/2018 |
| CN | 107914005 | A | | 4/2018 |
| CN | 108115110 | A | | 6/2018 |
| CN | 110643926 | A | | 1/2020 |
| CN | 112899604 | A | | 6/2021 |
| DE | 3715326 | A1 | | 11/1988 |

* cited by examiner

NiCrBSi—$ZrB_2$ METAL CERAMIC POWDER, COMPOSITE COATING FOR HIGH TEMPERATURE PROTECTION, AND PREPARATION METHOD THEREFOR

CROSS-REFERENCE TO RELATED APPLICATIONS

This application is a continuation of International Patent Application No. PCT/CN20122/072124 with a filing date of Jan. 14, 2022, designating the United States, now pending, and further claims priority to Chinese Patent Application No. 202110062825.6 with a filing date of Jan. 18, 2021. The content of the aforementioned applications, including any intervening amendments thereto, are incorporated herein by reference.

TECHNICAL FIELD

The present disclosure relates to the technical field of metal ceramic coating, and in particular, to a NiCrBSi—$ZrB_2$ metal ceramic powder, composite coating for high temperature protection, and a preparation method therefor.

BACKGROUND

The energy and chemical fields are mainly facing the challenges of corrosion and wear in high temperature environment. It has become an economical and practical method to deposit high-temperature protective coatings on the surface of key equipment and spare parts using thermal spraying technology to enhance the corrosion and wear resistance of materials. At present, the research on high-temperature protective coatings mainly focuses on alloy coatings, ceramic coatings and metal ceramic composite coatings. Although having excellent high-temperature corrosion resistance, a single alloy coating has low hardness and cannot meet the requirements of high temperature wear environment. Although having high hardness and excellent high-temperature corrosion and wear resistance, the ceramic coating has large brittleness and poor impact resistance, and is easy to fracture during use. The metal ceramic composite coating combines the strength and toughness of alloy with the high temperature characteristics of ceramic, and has excellent high-temperature corrosion and wear resistance. Therefore, the metal ceramic composite coating is the preferred high-temperature protective coating in harsh environment. The metal ceramic coating prepared by the high velocity oxygen fuel (HVOF) technology has low porosity and high bonding strength. The high-temperature and high-pressure flame flow is generated by combustion of hydrocarbon fuels such as propane and propylene, or liquid fuels such as aviation kerosene and high pressure oxygen in the combustion chamber, such that the particles hit the substrate at a high speed to form a compact coating. The low deposition temperature also reduces the oxidation of the coating. In addition, the HVOF technology has advantages of cost-effectiveness, portable equipment, and suitability for on-site repair operations, which are not provided by other thermal spraying technologies such as plasma spraying and arc spraying.

The WC—Co, NiCr—$Cr_3C_2$, and NiCrBSi(Fe)—WC metal ceramic coatings are widely used at present. The carbide hard phase added in the coating makes the metal ceramic coating have higher hardness and more excellent wear resistance than the alloy coating. However, the WC phase in WC—Co coating is unstable and easy to decompose at high temperature (generally not higher than 500° C.). Although the use temperature of the NiCr—$Cr_3C_2$ coating can reach 900° C., the intrinsic hardness of the $Cr_3C_2$ phase is low, which makes the wear and erosion resistance of the coating not ideal. The NiCrBSi (Fe)—WC coating has excellent high-temperature wear resistance, but the mismatch of thermal expansion between metal phase and ceramic phase at 500° C. and the low oxidation resistance of WC phase lead to its poor thermal corrosion resistance. Therefore, it is necessary to find a ceramic phase to replace carbide to improve the high-temperature corrosion resistance and wear resistance of the coating, such that it can be used in high-temperature corrosion and wear environment such as energy and chemical industry.

As an ultra-high temperature material, $ZrB_2$ has high melting point (3,246° C.), high thermal conductivity (39 W/mK), low density (6.12 g/cm$^3$), low thermal expansion coefficient ($6.88\times10^{-6}$ $K^{-1}$), high hardness, and excellent oxidation resistance, thermal shock resistance and corrosion resistance. However, $ZrB_2$ has poor toughness, and can only be compacted at very high temperature. The NiCrBSi self-fluxing alloy coating has excellent high-temperature corrosion resistance, but it has low hardness and poor high-temperature wear resistance. Adding the $ZrB_2$ phase to NiCrBSi can make up for the poor compactness of $ZrB_2$ by using the low melting point of the nickel-based alloy metal bonding phase and $SiO_2$ and $B_2O_3$ formed by Si and B at high temperature. Therefore, the prepared metal ceramic powder has certain compactness and fluidity, and is suitable for preparation of coatings with surface treatment methods such as thermal spraying, and improvement of the hardness of coatings and high-temperature corrosion resistance and wear resistance. At present, the main methods for preparing metal ceramic powder are melting, sintering and crushing, and coating methods. The powder prepared by the melting and sintering and crushing has irregular morphology, poor sphericity and poor fluidity, and is not suitable for the HVOF. The powder prepared by the coating method has uneven composition and low structural strength. Combining advantages of the traditional methods for preparing metal ceramic powder, the present disclosure innovatively combines mechanical ball milling, spray granulation, and vacuum sintering to prepare metal ceramic powder with excellent sphericity, excellent fluidity and high compactness. In addition, for the powder prepared by the method, the process parameters of the HVOF are optimized accordingly, and the composite coating with low porosity and high bonding strength is obtained.

Through long-term research and practices, the present disclosure is provided to overcome the above defects.

SUMMARY

An objective of the present disclosure is to solve problems of poor high-temperature compactness of $ZrB_2$ ceramics and corrosion and wear of high-temperature service parts in energy and chemical fields, and provide a NiCrBSi—$ZrB_2$ metal ceramic powder, composite coating for high temperature protection, and a preparation method therefor.

To achieve the above objective, the present disclosure discloses a method for preparing a NiCrBSi—$ZrB_2$ metal ceramic powder for high temperature protection, including the following steps:

a, mechanical ball milling: adding NiCrBSi powder, $ZrB_2$ powder, alcohol and zirconia grinding balls to a ball milling tank in proportion, and conducting ball milling at 300-350 r/min for 30-40 h to obtain a mixed powder solution containing alcohol;

b, drying of the mixed powder solution: heating the mixed powder solution containing alcohol in a constant temperature blast drying oven at 50° C. for 12 h to obtain a dried mixed powder;

c, preparation of slurry: adding a binder polyvinyl alcohol (PVA), a defoamer n-octanol, and deionized water into the dried mixed powder, and stirring and standing to obtain water-based composite slurry;

d, spray granulation: continuously stirring the water-based composite slurry, and sending the water-based composite slurry to a high-speed centrifugal spray dryer through a constant-flow pump for atomization to form spherical powder particles, where the high-speed centrifugal spray dryer has an inlet temperature of 200-240° C., an outlet temperature of 100-130° C., and an atomizing rotary frequency of 36 Hz, and the constant-flow pump works at 26 r/min;

e, vacuum sintering: conducting vacuum sintering on the spherical powder particles using a vacuum sintering furnace to obtain a metal ceramic powder; and f, sieving and grading: conducting sieving and grading on the metal ceramic powder by a vibrating sieve and an ultrasonic vibrator to obtain the NiCrBSi—$ZrB_2$ metal ceramic powder with a particle size distribution of 15-45 μm, wherein a pulse frequency of the ultrasonic vibrator is 2-3 Hz.

In step a, the NiCrBSi powder has a particle size of 20-50 μm, and includes the following elements in mass percentage: 0.3%-1.0% of C, 8%-18% of Cr, 2.5%-5.5% of Si, 1.8%-4.5% of B, 65%-85% of Ni, and less than 5% of Fe. The $ZrB_2$ powder has a particle size of 1-3 μm and a purity greater than or equal to 99.85%. The NiCrBSi powder and the $ZrB_2$ powder have a mass ratio of (6-8):(4-2). 55.5 mL of the alcohol is added into every 100 g of the NiCrBSi and $ZrB_2$ powders. The zirconia grinding balls with diameters of 15 mm, 13 mm, 11 mm, 10 mm, and 6 mm are mixed with a quantity ratio of 1:3:3:2:1, and the grinding balls and the NiCrBSi and $ZrB_2$ powders have a mass ratio of 2:1.

In step c, a percentage of the binder PVA to a total mass of the NiCrBSi and $ZrB_2$ powders is 3%-3.5%, a percentage of the defoamer n-octanol to the total mass of the NiCrBSi and $ZrB_2$ powders is 0.4%-0.5%, and the deionized water is added with an amount enabling a solid content of the NiCrBSi and $ZrB_2$ powders in the slurry to reach 40%.

In step e, the vacuum sintering comprises: heating the spherical powder particles for 40 min to rise a temperature from a room temperature to 300° C. and keeping 300° C. for 30 min, heating the spherical powder particles for 80 min to rise the temperature from 300° C. to 900-1,100° C. and keeping 900-1,100° C. for 6 h, and stopping heating the spherical powder particles and cooling to the room temperature.

The present disclosure further discloses a NiCrBSi—$ZrB_2$ metal ceramic powder for high temperature protection prepared by the above method. The NiCrBSi—$ZrB_2$ metal ceramic powder has a particle size of 15-45 μm, an apparent density of 1.51-2.13 g/cm$^2$, and fluidity of 69.8-98.3 s/50 g.

The present disclosure further discloses a method for preparing a NiCrBSi—$ZrB_2$ composite coating for high temperature protection, including the following steps:

S1: preparing the above NiCrBSi—$ZrB_2$ metal ceramic powder for high temperature protection;

S2: conducting oil removal and purification on a steel substrate surface of a boiler, conducting sand blasting on the surface, and preheating the substrate; and S3: spraying the metal ceramic powder obtained in step S1 on the steel substrate surface of the boiler by using the high velocity oxygen fuel (HVOF) technology with oxygen-propane as fuel and taking oxygen as a combustion improver, propane as fuel, nitrogen as powder feeding carrier gas, and air as a cooling medium to prepare and form the NiCrBSi—$ZrB_2$ composite coating.

In step S2, the sand blasting is conducted with a sand blasting material of brown corundum sand with a particle size of 25 meshes at a pressure of 3-5 MPa; and after the sand blasting, surface roughness of the substrate reaches 2.5-3 μm, and a preheating temperature of the substrate reaches 80-120° C.

In step S3, the propane has a flow rate of 60-70 L/min, the oxygen has a flow rate of 230-250 L/min, the air has a flow rate of 320-350 L/min, 230-250 mm of the spraying is conducted with a step of 3 mm at 800 mm/s, a powder feeding voltage is 5-5.5 V, and a powder feeding rate is 50-60 g/min.

The present disclosure further discloses a NiCrBSi—$ZrB_2$ composite coating for high temperature protection, prepared by the above method. The coating has a thickness of 200-300 μm and hardness of 700-1,000 HV, bonding strength between the coating and the substrate exceeds 75 MPa, and a porosity of the coating reaches 0.4%-0.5%.

Compared with the prior art, the present disclosure has the following beneficial effects:

(1) The metal ceramic powder prepared by a method combining mechanical ball milling, spray granulation, and vacuum sintering has excellent sphericity, excellent apparent density and fluidity, and even distribution of powder composition, which overcomes the shortcomings of poor sphericity, poor fluidity and uneven composition of the powder prepared by traditional mechanical ball milling and sintering. In addition, the low melting point of the nickel-based alloy metal bonding phase and the fluidity of $SiO_2$ and $B_2O_3$ formed by Si and B at high temperature are used to make up for the poor compactness of $ZrB_2$ sintering at high temperature.

(2) The prepared NiCrBSi—$ZrB_2$ composite coating has a thickness of 200-300 μm and hardness of 1,000 HV, bonding strength between the coating and the substrate is greater than 75 MPa, and a porosity of the coating reaches 0.4%-0.5%.

(3) m-$ZrO_2$ and $SiO_2$ are formed on the surface of the composite coating prepared by the present disclosure in a high-temperature corrosion environment, which improves the high-temperature corrosion resistance of the coating. Less $ZrB_2$ loss during spraying makes the composite coating have high hardness and excellent high-temperature wear resistance. In addition, the method for preparing the NiCrBSi—$ZrB_2$ composite coating is simple, the raw material cost is low, and the application range is expanded.

(4) The HVOF technology used in the present disclosure takes oxygen-propane as fuel. Compared with the use of oxygen-kerosene fuel, the use of oxygen-propane in the HVOF technology has the characteristics of cost-effectiveness and portable equipment, and is suitable for field repair operations and industrial production. By adjusting process parameters, it can achieve similar performance to that of the oxygen-kerosene spraying coating.

DETAILED DESCRIPTION OF THE EMBODIMENTS

Figure 1:
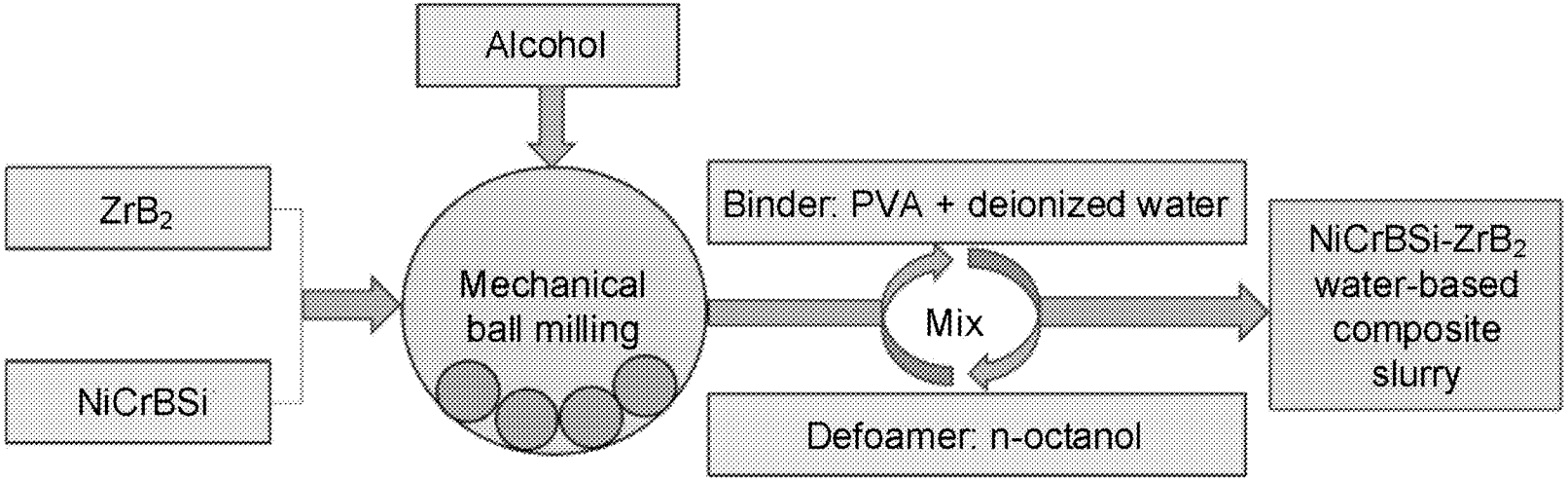
FIG. 1 shows a preparation process of NiCrBSi—$ZrB_2$ metal ceramic powder water-based composite slurry in the present disclosure.
Figure 2:
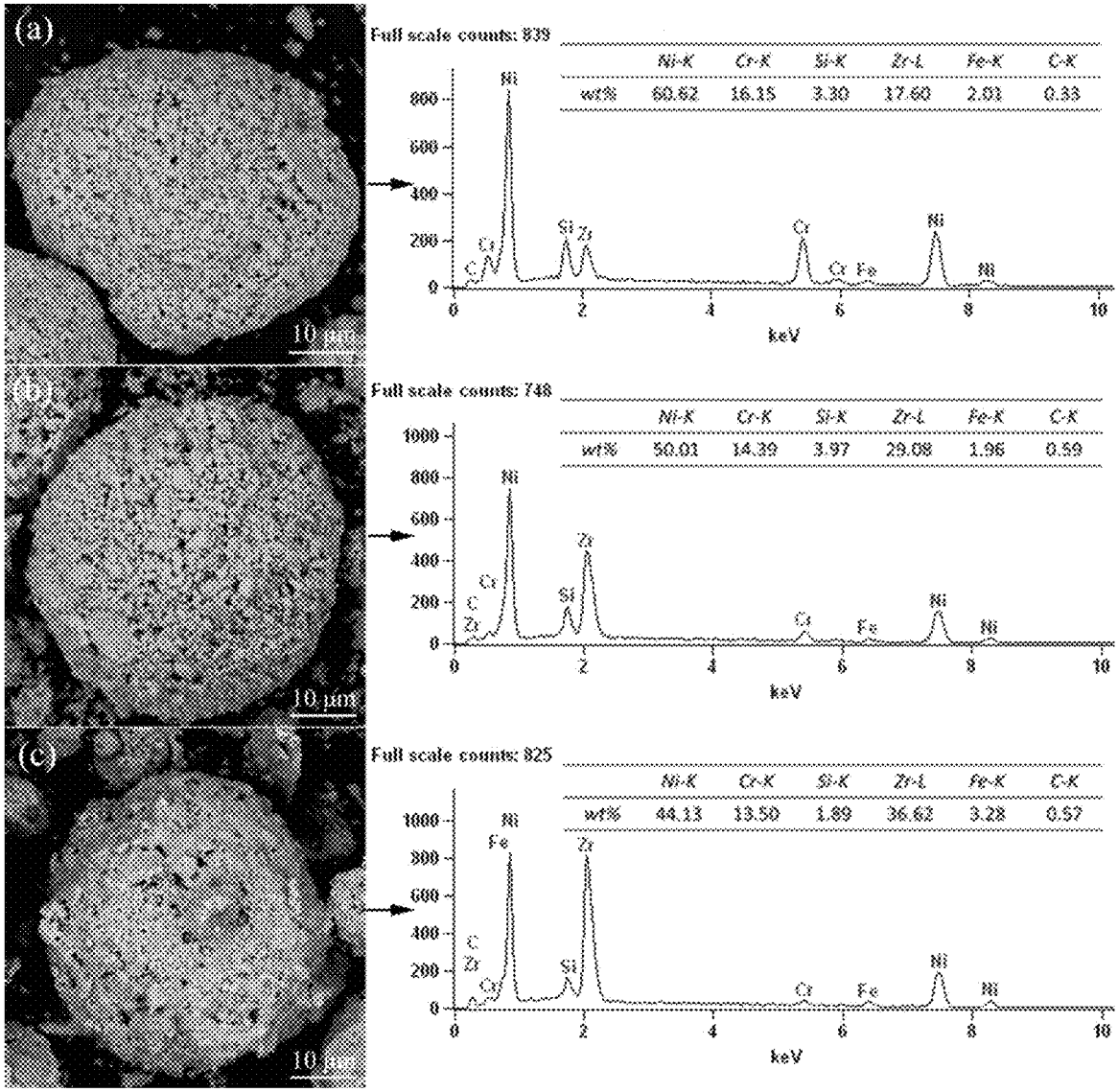
FIG. 2 shows surface morphology and energy dispersive spectroscopy (EDS) results of a NiCrBSi—$ZrB_2$ powder in Examples 1, 2 and 3 of the present disclosure: (a) NiCrBSi-20$ZrB_2$, (b) NiCrBSi-30$ZrB_2$, and (c) NiCrBSi-40$ZrB_2$.
Figure 3:
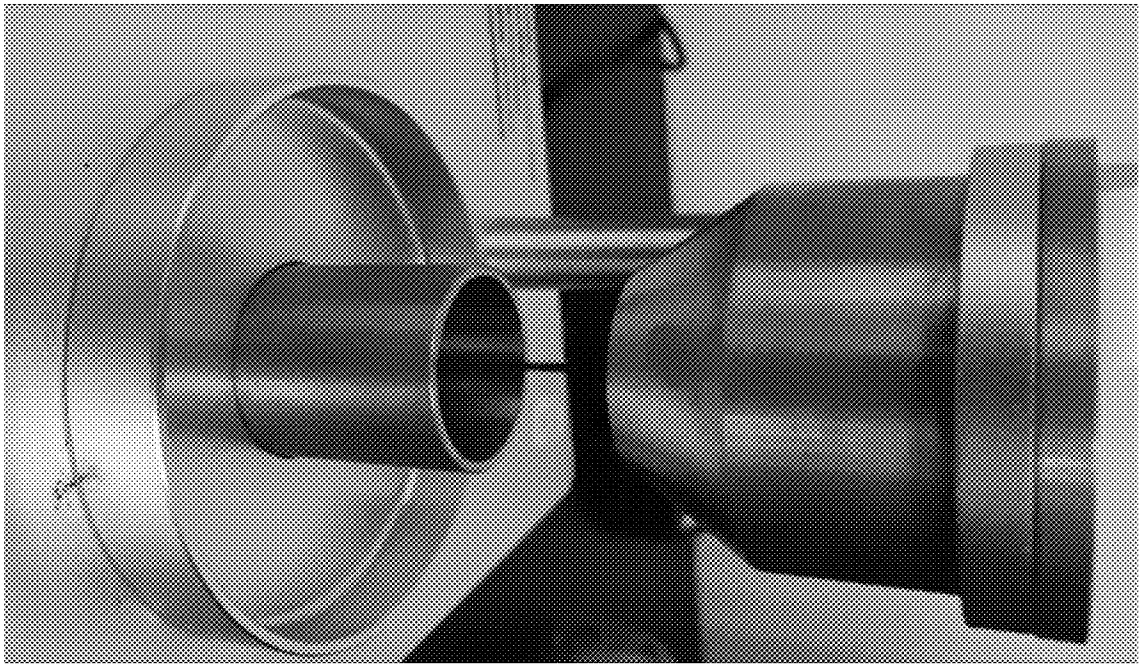
FIG. 3 shows a macroscopic picture of apparent density and fluidity of the NiCrBSi—$ZrB_2$ powder measured with a Hall flowmeter.
Figure 4:
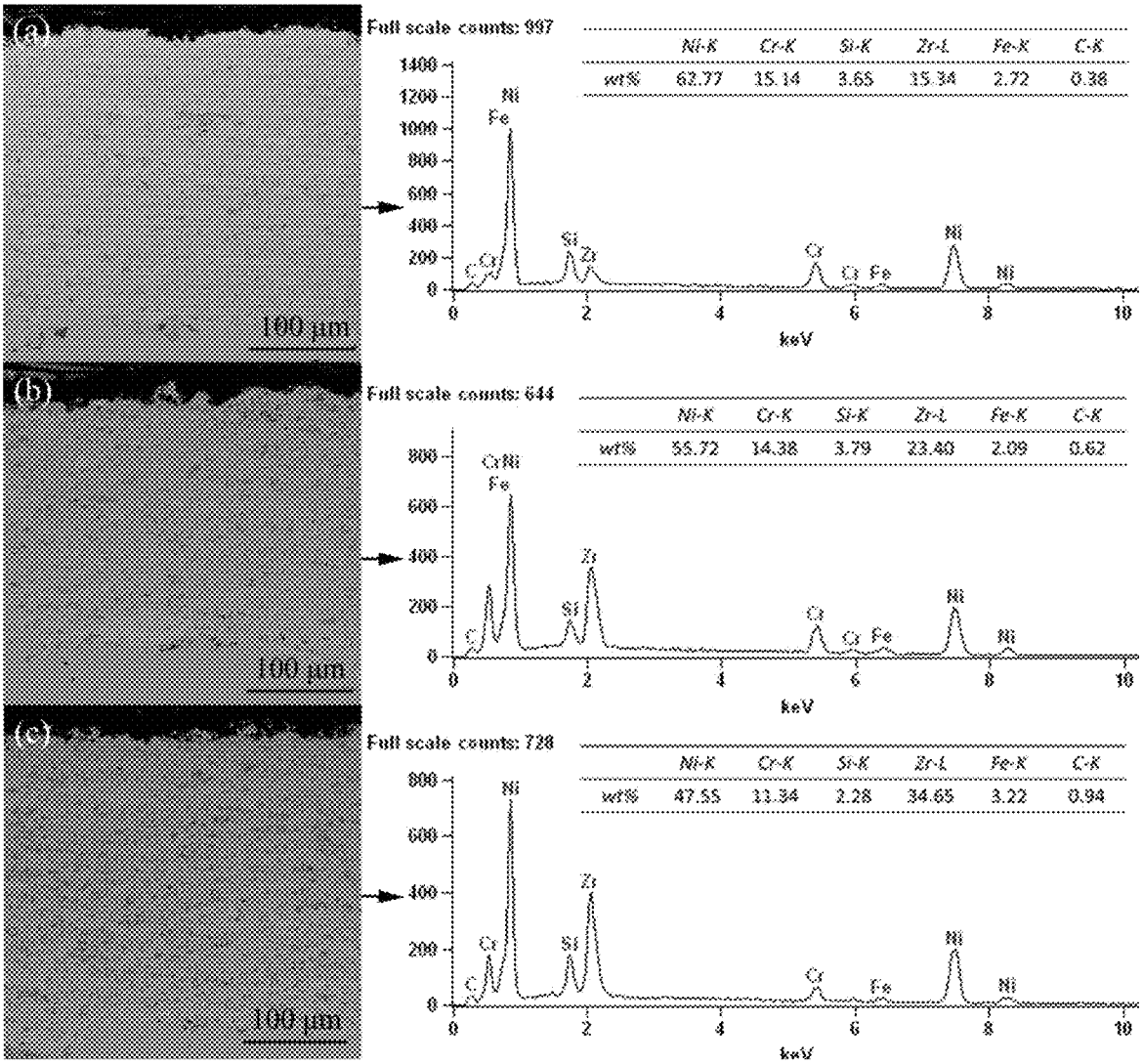
FIG. 4 shows sectional morphology and EDS results of a NiCrBSi—$ZrB_2$ composite coating in Examples 1, 2 and 3 of the present disclosure: (a) NiCrBSi-20$ZrB_2$, (b) NiCrBSi-30$ZrB_2$, and (c) NiCrBSi-40$ZrB_2$.
Figure 5:
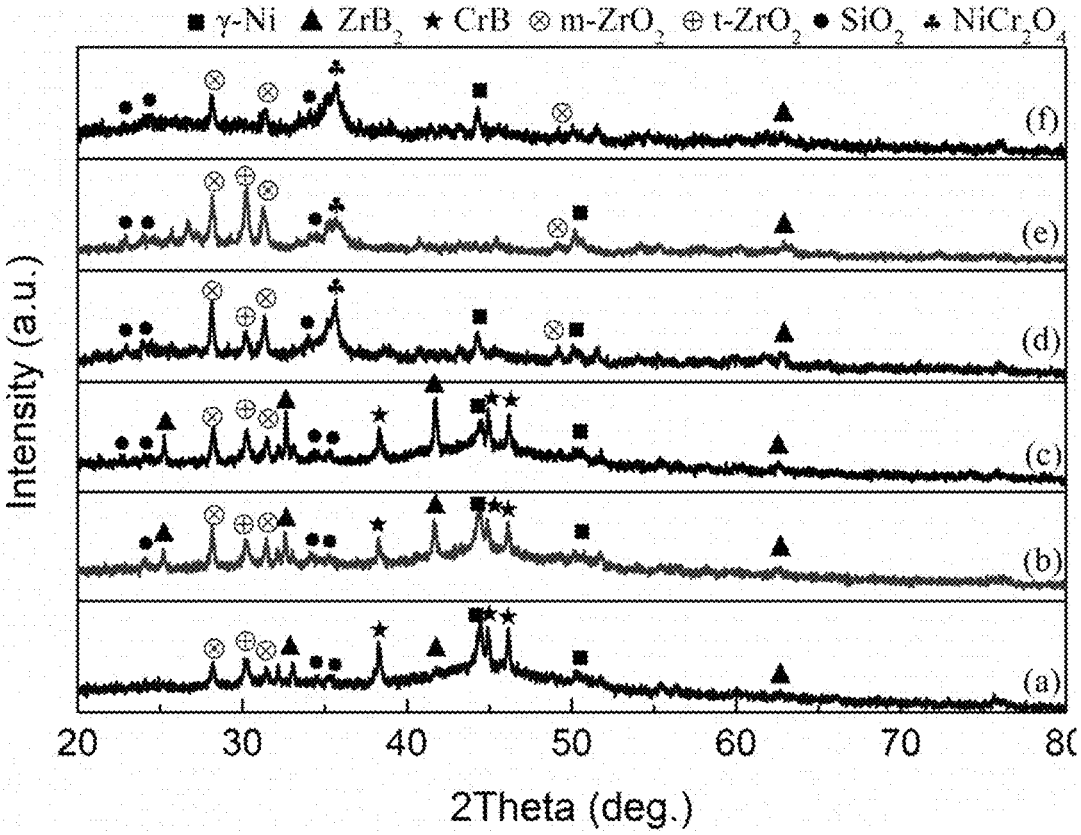
FIG. 5 shows an X-ray diffraction (XRD) pattern of a surface of the NiCrBSi—$ZrB_2$ composite coating in a sprayed state and after thermal corrosion in Examples 1, 2 and 3 of the present disclosure: (a) and (d) NiCrBSi-20$ZrB_2$, (b) and (e) NiCrBSi-30$ZrB_2$, and (c) and (f) NiCrBSi-40$ZrB_2$.

The above and other technical features and advantages of the present disclosure will be described below in more details in connection with the accompanying drawings.

Example 1

NiCrBSi powder with a mass percentage of 80% and $ZrB_2$ powder with a mass percentage of 20% were taken, mixed and added into a ball milling tank. Zirconia grinding balls with a mass twice that of the powder were added into the ball milling tank. The zirconia grinding balls with diameters of 15 mm, 13 mm, 11 mm, 10 mm, and 6 mm are mixed with a quantity ratio of 1:3:3:2:1. Alcohol was added into the ball milling tank at a ratio of adding 55.5 mL of the alcohol into every 100 g of the NiCrBSi and $ZrB_2$ powders. Ball milling was conducted at 320 r/min for 40 h.

After the ball milling, the mixed powder solution containing alcohol was placed in a constant temperature blast drying oven, a heating temperature was set at 50° C., and heat preservation was conducted for 12 h. After the powder was dried, a binder PVA with an amount being 3.5% of a total mass of the powder, a defoamer n-octanol with an amount being 0.5% of the total mass of the powder, and deionized water were added, so as to enable a solid content of the powder to reach 40%. The prepared water-based composite slurry was constantly stirred, such that the powder particles and the binder were evenly dispersed in the slurry.

The water-based composite slurry was constantly stirred, and sent to a high-speed centrifugal spray dryer through a constant-flow pump for atomization to form spherical powder particles. The high-speed centrifugal spray dryer was set at an inlet temperature of 240° C., an outlet temperature of 100° C., and an atomizing rotary frequency of 36 Hz, and the constant-flow pump worked at 26 r/min.

The metal ceramic powder after spray granulation was collected and placed in an alumina crucible for vacuum sintering. A vacuum sintering program was set. The powder was heated for 40 min to rise a temperature from a room temperature to 300° C. and the temperature was kept for 30 min, and then heated for 80 min to rise the temperature from 300° C. to 1,000° C. and the temperature was kept for 6 h, and the powder was stopped heating and cooled to the room temperature with the furnace.

The metal ceramic powder obtained by vacuum sintering was sieved and graded. The powder was sieved with metal screens with mesh numbers of 15 μm and 45 μm. An ultrasonic vibrator was loaded at the edge of the screen frame to assist powder sieving when a screen with a small mesh number was used. A pulse frequency of the ultrasonic vibrator is selected as 3 Hz. The NiCrBSi—$ZrB_2$ metal ceramic powder with a particle size distribution of 15-45 μm was obtained by sieving with screens with different mesh numbers.

Oil removal and purification were conducted on a steel substrate surface of a boiler with removal powder, alcohol and acetone. Sand blasting was conducted on the surface subjected to oil removal. The sand blasting was conducted with a sand blasting material of brown corundum sand with a particle size of 25 meshes ($Al_2O_3$). An air valve was adjusted to make the sand blasting pressure reach 3 MPa. After the sand blasting, the surface roughness Ra of the substrate reached 2.5 μm. The power supply, gas path switch and cooling water switch of the spraying equipment were turned on. The oxygen was used as a combustion improver, propane as fuel, nitrogen as powder feeding carrier gas, and air as a cooling medium. A sample was fixed on the workbench. The operation program of the mechanical arm was modified, such that the spraying distance reach 250 mm, and the spraying was conducted at 800 mm/s with a step of 3 mm. The propane, oxygen and air flow valves were opened. The flow rate of the propane was adjusted to 65 L/min, the flow rate of the oxygen to 240 L/min, and the flow rate of the air to 350 L/min. The propane flame flow was ignited to preheat the substrate surface, such that the surface temperature reached 80-120° C. The powder feeder switch was turned on. The powder feeding voltage was adjusted to 5 V. The powder feeding rate was maintained at 50 g/min. After every 5 times of spraying, the coating surface was purged and cooled with an air gun, and the coating thickness was measured with a spiral micrometer. When the coating temperature was reduced to about 80° C., the spraying equipment was started to continue spraying, and the operations were repeated to finally make the coating thickness reach about 250 μm.

Example 2

NiCrBSi powder with a mass percentage of 70% and $ZrB_2$ powder with a mass percentage of 30% were taken, mixed and added into a ball milling tank. Zirconia grinding balls with a mass twice that of the powder were added into the ball milling tank. The zirconia grinding balls with diameters of 15 mm, 13 mm, 11 mm, 10 mm, and 6 mm were selected and were compounded at a ratio of 1:3:3:2:1. Alcohol was added into the ball milling tank at a ratio of adding 55.5 mL of the alcohol into every 100 g of the NiCrBSi and $ZrB_2$ powders. Ball milling was conducted at 300 r/min for 30 h.

After the ball milling, the mixed powder solution containing alcohol was placed in a constant temperature blast drying oven, a heating temperature was set at 50° C., and heat preservation was conducted for 12 h. After the powder was dried, a binder PVA with an amount being 3% of a total mass of the powder, a defoamer n-octanol with an amount being 0.4% of the total mass of the powder, and deionized water were added, so as to enable a solid content of the powder to reach 40%. The prepared water-based composite slurry was constantly stirred, such that the powder particles and the binder were evenly dispersed in the slurry.

The water-based composite slurry was constantly stirred, and sent to a high-speed centrifugal spray dryer through a constant-flow pump for atomization to form spherical powder particles. The high-speed centrifugal spray dryer was set at an inlet temperature of 240° C., an outlet temperature of 110° C., and an atomizing rotary frequency of 36 Hz, and the constant-flow pump worked at 26 r/min.

The metal ceramic powder after spray granulation was collected and placed in an alumina crucible for vacuum sintering. A vacuum sintering program was set. The powder was heated for 40 min to rise the temperature from a room temperature to 300° C. and the temperature was kept for 30 min, and then heated for 80 min to rise the temperature from 300° C. to 900° C. and the temperature was kept for 6 h, and the powder was stopped heating and cooled to the room temperature with the furnace.

The metal ceramic powder obtained by vacuum sintering was sieved and graded. The powder was sieved with metal screens with mesh numbers of 15 μm and 45 μm. An ultrasonic vibrator was loaded at the edge of the screen frame to assist powder sieving when a screen with a small mesh number was used. A pulse frequency of the ultrasonic vibrator is selected as 2.5 Hz. The NiCrBSi—$ZrB_2$ metal ceramic powder with a particle size distribution of 15-45 μm was obtained by sieving with screens with different mesh numbers.

Oil removal and purification were conducted on a steel substrate surface of a boiler with removal powder, alcohol and acetone. Sand blasting was conducted on the surface subjected to oil removal. The sand blasting was conducted with a sand blasting material of brown corundum sand with a particle size of 25 meshes ($Al_2O_3$). An air valve was adjusted to make the sand blasting pressure reach 3 MPa. After the sand blasting, the surface roughness Ra of the substrate reached 2.5 μm. The power supply, gas path switch and cooling water switch of the spraying equipment were turned on. The oxygen was used as a combustion improver, propane as fuel, nitrogen as powder feeding carrier gas, and air as a cooling medium. A sample was fixed on the workbench. The operation program of the mechanical arm was modified, such that the spraying distance reach 230 mm, and the spraying was conducted at 800 mm/s with a step of 3 mm. The propane, oxygen and air flow valves were opened. The flow rate of the propane was adjusted to 60 L/min, the flow rate of the oxygen to 230 L/min, and the flow rate of the air to 320 L/min. The propane flame flow was ignited to preheat the substrate surface, such that the surface temperature reached 80-120° C. The powder feeder switch was turned on. The powder feeding voltage was adjusted to 5 V. The powder feeding rate was maintained at 50 g/min. After every 5 times of spraying, the coating surface was purged and cooled with an air gun, and the coating thickness was measured with a spiral micrometer. When the coating temperature was reduced to about 80° C., the spraying equipment was started to continue spraying, and the operations were repeated to finally make the coating thickness reach about 250 μm.

Example 3

NiCrBSi powder with a mass percentage of 60% and $ZrB_2$ powder with a mass percentage of 40% were taken, mixed and added into a ball milling tank. Zirconia grinding balls with a mass twice that of the powder were added into the ball milling tank. The zirconia grinding balls with diameters of 15 mm, 13 mm, 11 mm, 10 mm, and 6 mm were selected and were compounded at a ratio of 1:3:3:2:1. Alcohol was added into the ball milling tank at a ratio of adding 55.5 mL of the alcohol into every 100 g of the NiCrBSi and $ZrB_2$ powders. Ball milling was conducted at 320 r/min for 40 h.

After the ball milling, the mixed powder solution containing alcohol was placed in a constant temperature blast drying oven, a heating temperature was set at 50° C., and heat preservation was conducted for 12 h. After the powder was dried, a binder PVA with an amount being 3.5% of a total mass of the powder, a defoamer n-octanol with an amount being 0.5% of the total mass of the powder, and deionized water were added, so as to enable a solid content of the powder to reach 40%. The prepared water-based composite slurry was constantly stirred, such that the powder particles and the binder were evenly dispersed in the slurry.

The water-based composite slurry was constantly stirred, and sent to a high-speed centrifugal spray dryer through a constant-flow pump for atomization to form spherical powder particles. The high-speed centrifugal spray dryer was set at an inlet temperature of 240° C., an outlet temperature of 100° C., and an atomizing rotary frequency of 36 Hz, and the constant-flow pump worked at 26 r/min.

The metal ceramic powder after spray granulation was collected and placed in an alumina crucible for vacuum sintering. A vacuum sintering program was set. The powder was heated for 40 min to rise the temperature from a room temperature to 300° C. and the temperature was kept for 30 min, and then heated for 80 min to rise the temperature from 300° C. to 1,000° C. and the temperature was kept for 6 h, and the powder was stopped heating and cooled to the room temperature with the furnace.

The metal ceramic powder obtained by vacuum sintering was sieved and graded. The powder was sieved with metal screens with mesh numbers of 15 μm and 45 μm. An ultrasonic vibrator was loaded at the edge of the screen frame to assist powder sieving when a screen with a small mesh number was used. A pulse frequency of the ultrasonic vibrator is selected as 3 Hz. The NiCrBSi—$ZrB_2$ metal ceramic powder with a particle size distribution of 15-45 μm was obtained by sieving with screens with different mesh numbers.

Oil removal and purification were conducted on a steel substrate surface of a boiler with removal powder, alcohol and acetone. Sand blasting was conducted on the surface subjected to oil removal. The sand blasting was conducted with a sand blasting material of brown corundum sand with a particle size of 25 meshes ($Al_2O_3$). An air valve was adjusted to make the sand blasting pressure reach 3 MPa. After the sand blasting, the surface roughness Ra of the substrate reached 2.5 μm. The power supply, gas path switch and cooling water switch of the spraying equipment were turned on. The oxygen was used as a combustion improver, propane as fuel, nitrogen as powder feeding carrier gas, and air as a cooling medium. A sample was fixed on the workbench. The operation program of the mechanical arm was modified, such that the spraying distance reach 250 mm, and the spraying was conducted at 800 mm/s with a step of 3 mm. The propane, oxygen and air flow valves were opened. The flow rate of the propane was adjusted to 70 L/min, the flow rate of the oxygen to 250 L/min, and the flow rate of the air to 350 L/min. The propane flame flow was ignited to preheat the substrate surface, such that the surface temperature reached 80-120° C. The powder feeder switch was turned on. The powder feeding voltage was adjusted to 5 V. The powder feeding rate was maintained at 50 g/min. After every 5 times of spraying, the coating surface was purged and cooled with an air gun, and the coating thickness was measured with a spiral micrometer. When the coating temperature was reduced to about 80° C., the spraying equipment was started to continue spraying, and the operations were repeated to finally make the coating thickness reach about 250 μm.

I. Performance Test of NiCrBSi—$ZrB_2$ Metal Ceramic Powder Prepared in Examples 1 to 3 of the Present Disclosure The fluidity and apparent density of the powder were measured with a Hall flowmeter. Each powder sample was tested three times, and the average value was taken as the fluidity index and apparent density of the powder sample. The test results are shown in Table 1.

TABLE 1

Fluidity and apparent density of NiCrBSi—$ZrB_2$ metal ceramic powder prepared in Examples 1 to 3

| | Example 1 | Example 2 | Example 3 |
|---|---|---|---|
| Fluidity (s/50 g) | 98.35 | 80.42 | 67.24 |
| Apparent density ($g/cm^3$) | 1.51 | 1.63 | 1.59 |

II. Performance Test of NiCrBSi—$ZrB_2$ Composite Coating Prepared in Examples 1 to 3 of the Present Disclosure The microhardness of the coating was tested with a Vickers hardness tester. The load was 300 gf. The loading time was 5 s. 10 points were tested for each coating. The average value was taken as the microhardness of the coating. The test results are shown in Table 2.

TABLE 2

Microhardness of NiCrBSi—$ZrB_2$ composite coating prepared in Examples 1 to 3

| | Example 1 | Example 2 | Example 3 |
|---|---|---|---|
| Microhardness ($HV_{300}$) | 784 | 815 | 1006 |

Figure 6:
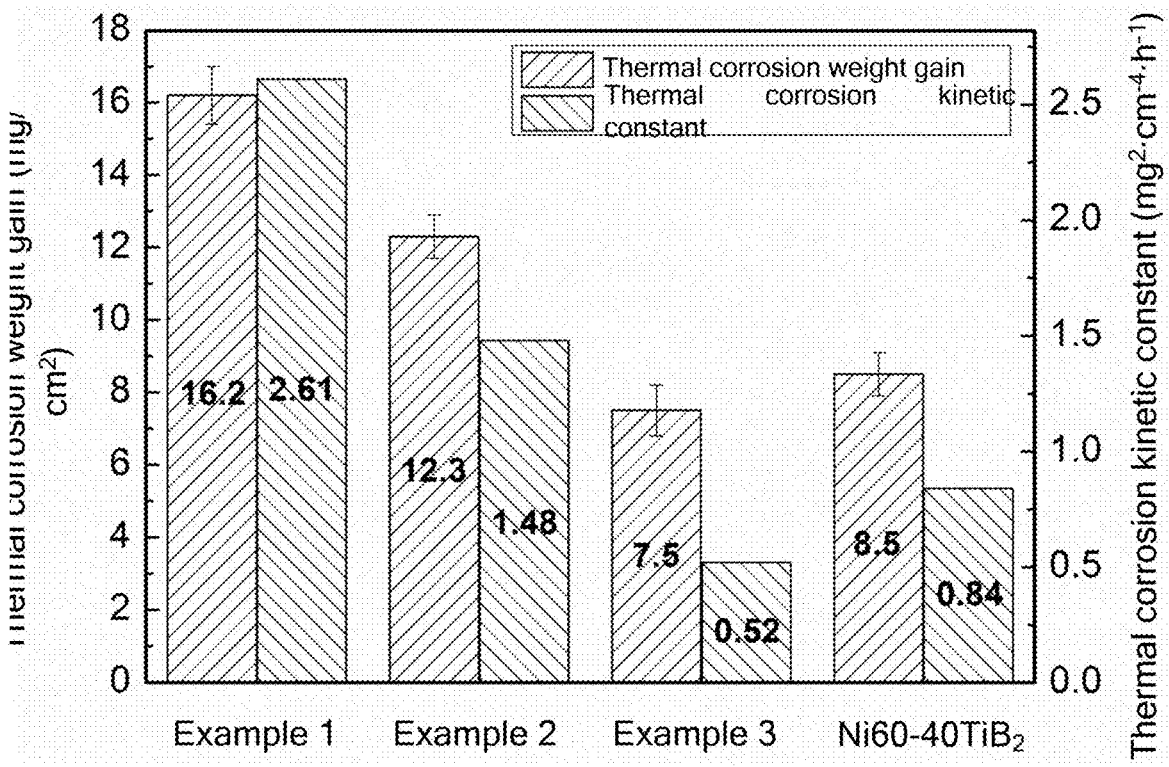
FIG. 6 is a comparison diagram of thermal corrosion weight gain and a thermal corrosion kinetic constant between the NiCrBSi—$ZrB_2$ composite coating and an Ni60-40$TiB_2$ coating in Examples 1, 2 and 3 of the present disclosure.

The KCl molten salt corrosion resistance of the NiCrBSi—$ZrB_2$ composite coating was tested in a tubular furnace. Three groups were tested for each coating. The experiment was carried out at 700° C. for 100 h. The samples were taken out and weighed every 10 h. The thermal corrosion weight gain of the coating was recorded, and the average thermal corrosion kinetic constant of the coating was calculated. The test results are shown in FIG. 6. Compared with the Ni60-40$TiB_2$ coating, the NiCrBSi-40$ZrB_2$ coating prepared in Example 3 formed the $SiO_2$ and m-$ZrO_2$ phases during thermal corrosion, and the m-$ZrO_2$ did not undergo an obvious conversion to t-$ZrO_2$. The continuous and compact oxide film on the coating surface could effectively prevent the corrosion diffusion of chloride molten salt into the coating, such that the coating had more excellent thermal corrosion resistance.

Figure 7:
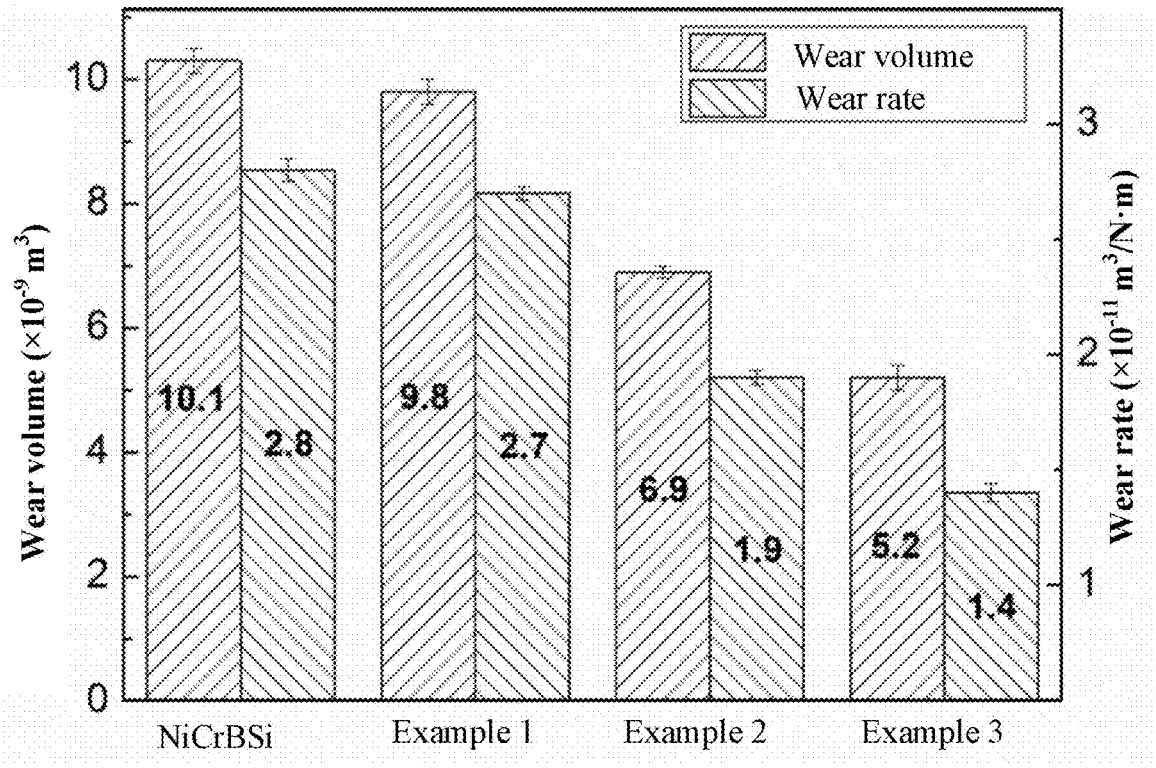
FIG. 7 is a comparison diagram of a high-temperature wear volume and wear rate between the NiCrBSi—$ZrB_2$ composite coating and a NiCrBSi coating in Examples 1, 2 and 3 of the present disclosure.

The high-temperature wear resistance of the NiCrBSi—$ZrB_2$ composite coating was tested in a HT-1000 high-temperature friction and wear testing machine. The wear load was 10 N, the wear temperature was 700° C., the frequency was 5.7 Hz, the friction radius was 3.5 mm, and the wear time was 60 min. The grinding balls adopted $Al_2O_3$ ceramic balls with a diameter of 5 mm, and the wear volume of the coating was calculated with a KLA-P7 probe profiler. The test results are shown in FIG. 7. The test results show that compared with the NiCrBSi coating, the NiCrBSi-40$ZrB_2$ coating prepared in Example 4 has high hardness and optimal high-temperature wear resistance because it contains many $ZrB_2$ hard phases.

In summary, the NiCrBSi—$ZrB_2$ composite coating for high temperature protection prepared by the present disclosure meets the requirements of high-temperature corrosion resistance and high-temperature wear resistance on the steel substrate surface of energy and chemical equipment, and the optimal powder and coating preparation technology can be obtained by improving the method and process flow. The metal ceramic powder which is prepared by means of a combination of mechanical ball milling, spray granulation, and vacuum sintering, has a mass ratio of NiCrBSi powder to $ZrB_2$ powder of 6:4, and is obtained after vacuum sintering at 1,000° C. has optimal fluidity and apparent density. By optimizing the spraying process parameters, optimal spraying process parameters are obtained: a propane flow rate of 70 L/min, an oxygen flow rate of 250 L/min, an air flow rate of 350 L/min, a spraying distance of 250 mm, a spraying step of 3 mm, a spraying speed of 800 mm/s, a powder feeding voltage of 5 V, and a powder feeding rate of 50 g/min. The composite coating prepared under these parameters has optimal high-temperature corrosion resistance due to the presence of the $SiO_2$ and m-$ZrO_2$ phases, and the composite coating has optimal high-temperature wear resistance due to the presence of many $ZrB_2$ phases.

The above described are merely preferred examples of the present disclosure, and are merely illustrative rather than restrictive. It is to be understood that many alterations, modifications or even equivalent replacements can be made within the spirit and scope defined by the claims of the present disclosure, and should fall within the protection scope of the present disclosure.

What is claimed is:

1. A method for preparing a NiCrBSi—ZrB2 metal ceramic powder for high temperature protection, comprising the following steps:

a. mechanical ball milling: adding NiCrBSi powder, ZrB2 powder, alcohol and zirconia grinding balls to a ball milling tank, and conducting ball milling at 300-350 r/min for 30-40 h to obtain a mixed powder solution containing alcohol;

b. drying of the mixed powder solution: heating the mixed powder solution containing alcohol in a constant temperature blast drying oven at 50° C. for 12 h to obtain a dried mixed powder;

c. preparation of slurry: adding a binder polyvinyl alcohol (PVA), a defoamer n-octanol, and deionized water into the dried mixed powder, and stirring and standing to obtain a water-based composite slurry;

d. spray granulation: continuously stirring the water-based composite slurry, and sending the water-based composite slurry to a high-speed centrifugal spray dryer through a constant-flow pump for atomization to form spherical powder particles, wherein the high-speed centrifugal spray dryer has an inlet temperature of 200-240° C., an outlet temperature of 100-130° C., and an atomizing rotary frequency of 36 Hz, and the constant-flow pump works at 26 r/min;

e. vacuum sintering: conducting vacuum sintering on the spherical powder particles using a vacuum sintering furnace to obtain a metal ceramic powder; and f. sieving and grading: conducting sieving and grading on metal ceramic powder by a vibrating sieve and an ultrasonic vibrator to obtain the NiCrBSi—ZrB2 metal ceramic powder, wherein a pulse frequency of the ultrasonic vibrator is 2-3 Hz.

2. The method according to claim 1, wherein in step a, the NiCrBSi powder has a particle size of 20-50 μm, and comprises the following elements in mass percentage: 0.3%-1.0% of C, 8%-18% of Cr, 2.5%-5.5% of Si, 1.8%-4.5% of B, 65%-85% of Ni, and less than 5% of Fe; and the ZrB2 powder has a particle size of 1-3 μm and a purity greater than or equal to 99.85%.

3. The method according to claim 1, wherein in step a, the NiCrBSi powder and the ZrB2 powder have a mass ratio of 6:4-8:2, 55.5 mL of the alcohol is added into every 100 g of the NiCrBSi and ZrB2 powders, and zirconia grinding balls with diameters of 15 mm, 13 mm, 11 mm, 10 mm, and 6 mm are mixed with a quantity ratio of 1:3:3:2:1, and the grinding balls and the NiCrBSi and ZrB2 powders have a mass ratio of 2:1.

4. The method according to claim 1, wherein in step c, a percentage of the binder PVA to a total mass of the NiCrBSi and ZrB2 powders is 3%-3.5%, a percentage of the defoamer n-octanol to the total mass of the NiCrBSi and ZrB2 powders is 0.4%-0.5%, and the deionized water is added with an amount enabling a solid content of the NiCrBSi and ZrB2 powders in the slurry to reach 40%.

5. The method according to claim 1, wherein in step e, the vacuum sintering in step e specifically comprises the following steps:

heating the spherical powder particles for 40 min to rise a temperature from a room temperature to 300° C. and keeping 300° C. for 30 min, heating the spherical powder particles for 80 min to rise the temperature from 300° C. to 900-1,100° C. and keeping 900-1,100° C. for 6 h, and stopping heating the spherical powder particles and cooling to the room temperature.

* * * * *